US005496103A

United States Patent [19]

Kozak

[11] Patent Number: 5,496,103

[45] Date of Patent: Mar. 5, 1996

[54] PRODUCT DISPLAY AND STORAGE CABINET

[76] Inventor: Burton Kozak, 1300 N. Lake Shore Dr., Chicago, Ill. 60610

[21] Appl. No.: 101,393

[22] Filed: Aug. 3, 1993

[51] Int. Cl.[6] ..... A47F 3/14

[52] U.S. Cl. ..... 312/118; 312/138.1; 312/116

[58] Field of Search ..... 312/114, 115, 312/116, 117, 118, 128, 138.1, 126, 290, 284, 286, 289; D6/472

[56] References Cited

U.S. PATENT DOCUMENTS

| | | | |
|---|---|---|---|
| 391,469 | 10/1888 | Hale | 312/128 |
| 1,106,543 | 8/1914 | Burnham et al. | 312/118 |
| 1,655,346 | 1/1928 | Van Sickels . | |
| 1,709,080 | 5/1929 | Krueger | 312/117 |
| 2,112,070 | 3/1938 | Coventry . | |
| 2,172,172 | 9/1939 | Mount . | |
| 2,503,419 | 5/1950 | Secunde | 312/116 |
| 4,285,558 | 8/1981 | Medford | 312/117 |

FOREIGN PATENT DOCUMENTS

| | | | |
|---|---|---|---|
| 0170721 | 7/1916 | Canada | 108/92 |
| 729224 | 2/1969 | France . | |
| 2728477A1 | 1/1979 | Germany . | |
| 9214414 | 12/1992 | Germany . | |

*Primary Examiner*—Kenneth J. Dorner
*Assistant Examiner*—Gerald A. Anderson
*Attorney, Agent, or Firm*—Marshall, O'Toole, Gerstein, Murray & Borun

[57] ABSTRACT

In order to visibly display products of various types and provide product storage therefor while restricting access to the products for security reasons and/or to maintain the products in a clean condition, a product display and storage cabinet is provided. The cabinet includes first and second distinct product display sections arranged integrally adjacent to one another. The first section has a plurality of distinct product display levels extending from a lower extreme to an upper extreme in generally step-like fashion. The cabinet also has a single product display level for the second section extending from the first section at one of the extremes thereof. In one embodiment, a plurality of walls integrally surround the first and second sections to define an enclosure for product storage and separate transparent lids cover the first section and the second section to restrict access thereto.

14 Claims, 3 Drawing Sheets

PRODUCT DISPLAY AND STORAGE CABINET

FIELD OF THE INVENTION

The present invention is generally directed to displaying products and, more particularly, a product display and storage cabinet with unique features.

BACKGROUND OF THE INVENTION

Generally speaking, it is known that there is a need for devices that are capable of displaying a product for sale. This is true of virtually every product manufactured for sale and, particularly in the retail environment, there are oftentimes special needs that must be met. In practice, these special needs are usually interrelated in a difficult, if not impossible, manner to successfully achieve.

More specifically, the primary requirement for nearly any product display device is to render the product visible. It is frequently an additional requirement to be able to display a plurality of different, but related, products in a single product display device and, in some instances, it is important to either restrict direct access to the products by the consumer or, at a minimum, to cover the products to keep them dust and dirt free and not readily accessible for handling by passing consumers. Still additionally, it is generally known that most retail environments suffer from a shortage of space for storage of products for sale.

As a result, those who market products have faced particularly perplexing problems in maximizing exposure to and availability of their products to the consuming public. The first of these problems centers on having a product display that permits adequate viewing of products in an attractive fashion while, if necessary, restricting access to and/or protecting the products from dust and dirt. Ironically, if the display of a product is successful, and the sales are at a significant level, a lack of storage may result in an inadequate inventory of that product.

For this reason, it would be highly advantageous to have what would functionally constitute a combined product display and storage cabinet particularly well suited for the retail market. This would allow not only for advantageously displaying a product or products in an attractive, secure and clean environment but also would provide storage at the point of display of the product so that there would also be an adequate inventory available to maintain the display with a full quantity of the product. Of course, the product display and storage cabinet should also be provided with suitable means for identifying one or more of the products and for placing possible pricing information thereon.

While the problems noted in connection with product display and cabinet storage are not product specific, it is particularly noteworthy that storage, display and sale of drill bits and screwdriver tips are known to suffer from the noted problems.

The present invention is directed to overcoming one or more of the foregoing problems and achieving one or more of the resulting objects.

SUMMARY OF THE INVENTION

It is a principal object of the present invention to provide a product display and storage cabinet. It is a further object of the present invention to provide such a cabinet that is not only capable of restricting access but also well suited for permitting the viewing of products therein. It is an additional object of the present invention to provide an enclosure for product storage.

Accordingly, the present invention is directed to a product display device comprising first and second distinct product display sections. These sections are arranged integrally adjacent to one another with the first section have a plurality of distinct product display levels extending from a lower extreme to an upper extreme in generally step-like fashion. In addition, the second section has a single product display level extending from the first section at one of the extremes thereof.

In the exemplary embodiment, the single product display level of the second section is positioned so as to extend from the first section generally at the upper of the extremes. It is also advantageous for the first section to include a plurality of product display bins at each of its product display levels and for the second section to include a generally flat, horizontal surface integral with and extending from the upper extreme of the first section. Still additionally, the device preferably includes a plurality of walls integrally surrounding the first and second sections to define an enclosure or cabinet for product storage therein.

With this understanding, the product display levels of the first section each preferably include a continuous outwardly facing vertical riser surface extending in front of all of the bins at that product display level. Also, the product display and storage cabinet of the present invention advantageously includes means associated with each of the riser surfaces for identifying and/or pricing a product in each of the bins immediately behind the riser surface. With this arrangement, the bins are preferably arranged in a plurality of rows and columns with each of the rows defining one of the product display levels and each of the columns defining vertical steps of the first section.

In a most highly advantageous embodiment, separate transparent means are provided for covering the first section and the second section to restrict access while permitting viewing of products within each of the sections. This may advantageously take the form of hinged covers or lids each preferably having a lock to restrict access to products therewithin. Still additionally, the walls defining the enclosure or cabinet preferably include a pair of parallel generally trapezoidal shaped sidewalls and a pair of parallel generally rectangular shaped front and back walls.

With these features of construction, the hinged covers or lids preferably include a generally planar lid normally resting on a recessed ledge of each of a pair of sloped surfaces of the generally trapezoidal shaped sidewalls so as to cover the contents in the bins of the first section. Also, the other of the hinged covers or lids preferably comprises a generally rectangular bubble shaped lid resting on the generally horizontal surface of the second section forwardly of a continuous outwardly facing vertical backstop extending upwardly of the generally horizontal surface remote from the first section.

Still additionally, the planar lid is preferably hinged generally at the upper extreme of the first section and the rectangular bubble shaped lid is hinged generally at the top of the vertical backstop.

Still other objects, advantages and features of the present invention will become apparent from a consideration of the following specification taken in conjunction with the accompanying drawings.

DETAILED DESCRIPTION OF THE PREFERRED EMBODIMENT

Figure 1:
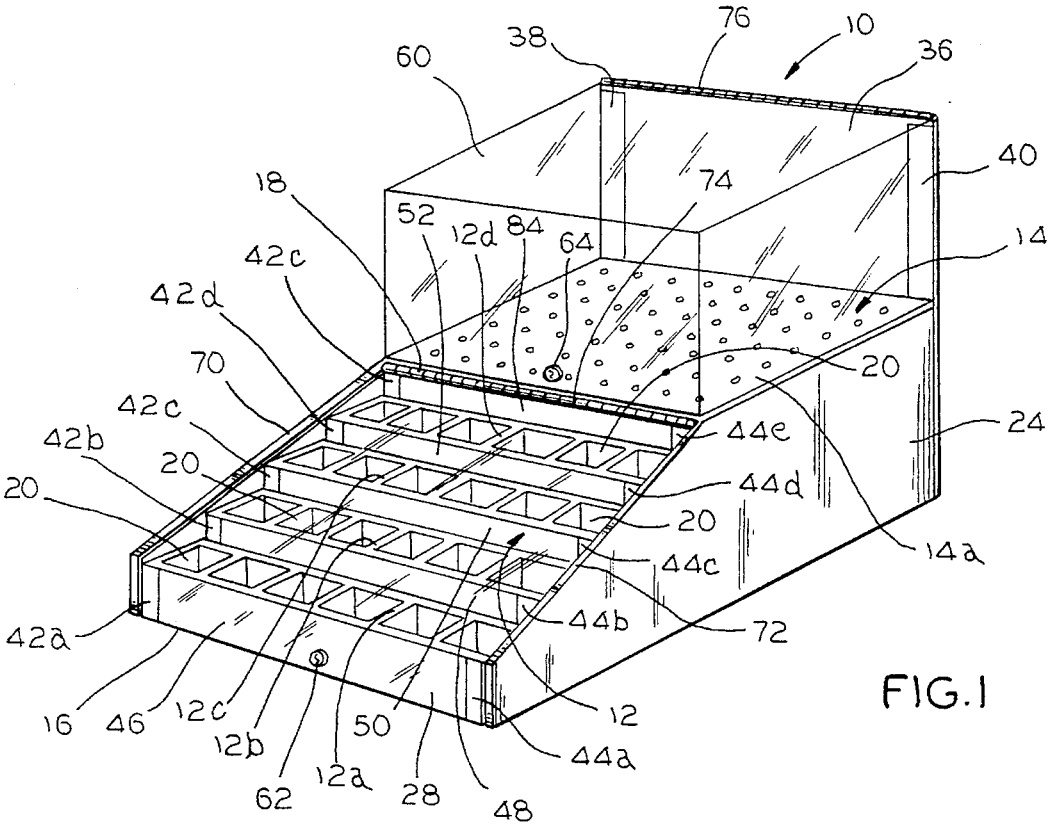
FIG. 1 is a front perspective view of a product display and storage cabinet in accordance with the present invention.

In the illustrations given, and with reference first to FIG. 1, the reference numeral 10 designates generally a product display and storage cabinet in accordance with the present invention. The cabinet 10 includes first and second product display sections 12 and 14 arranged so as to be integrally adjacent to one another with thee first section 12 having a plurality of distinct product display levels 12*a*, 12*b*, 12*c*, 12*d* extending from a lower extreme 16 to an upper extreme 18 in generally step-like fashion. As also shown, the cabinet 10 provides a single product display level 14*a* for the second section 14 which extends from the first section 12 generally at the upper of the extremes 18 thereof.

Figure 2:
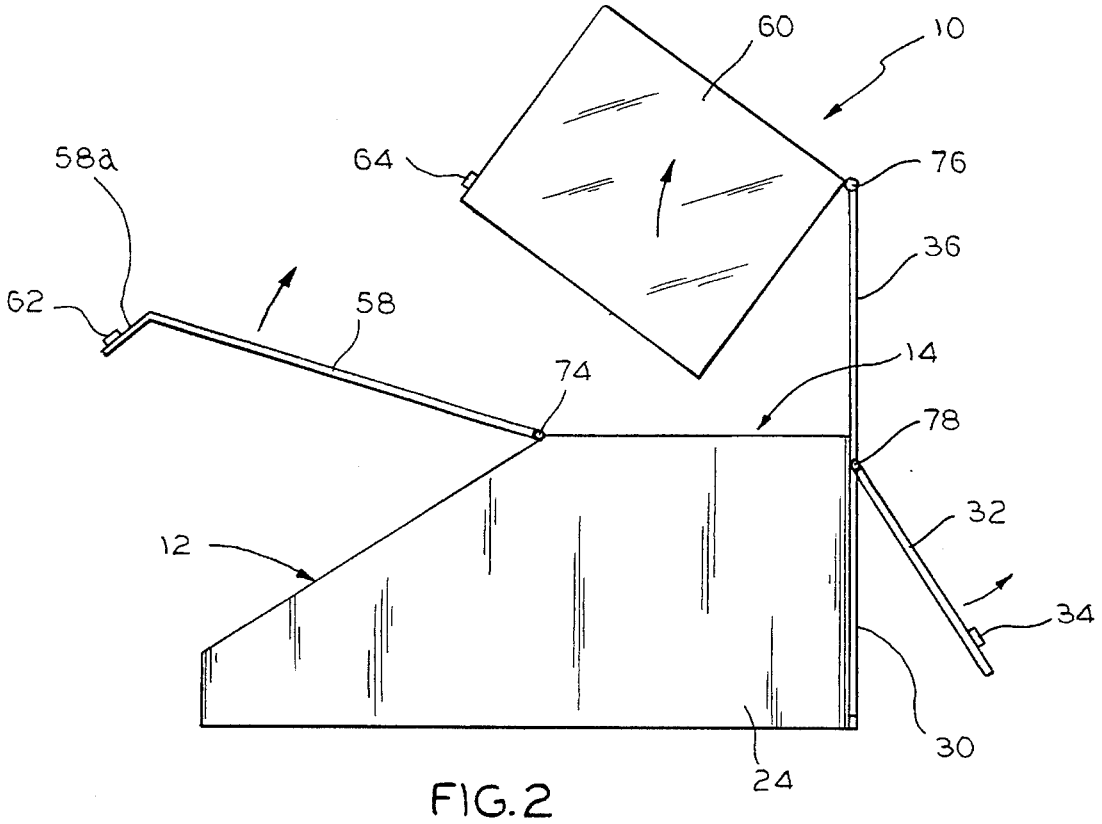
FIG. 2 is a side elevational view of the product display and storage cabinet of FIG. 1 with the covers or lids in a raised position.
Figure 3:
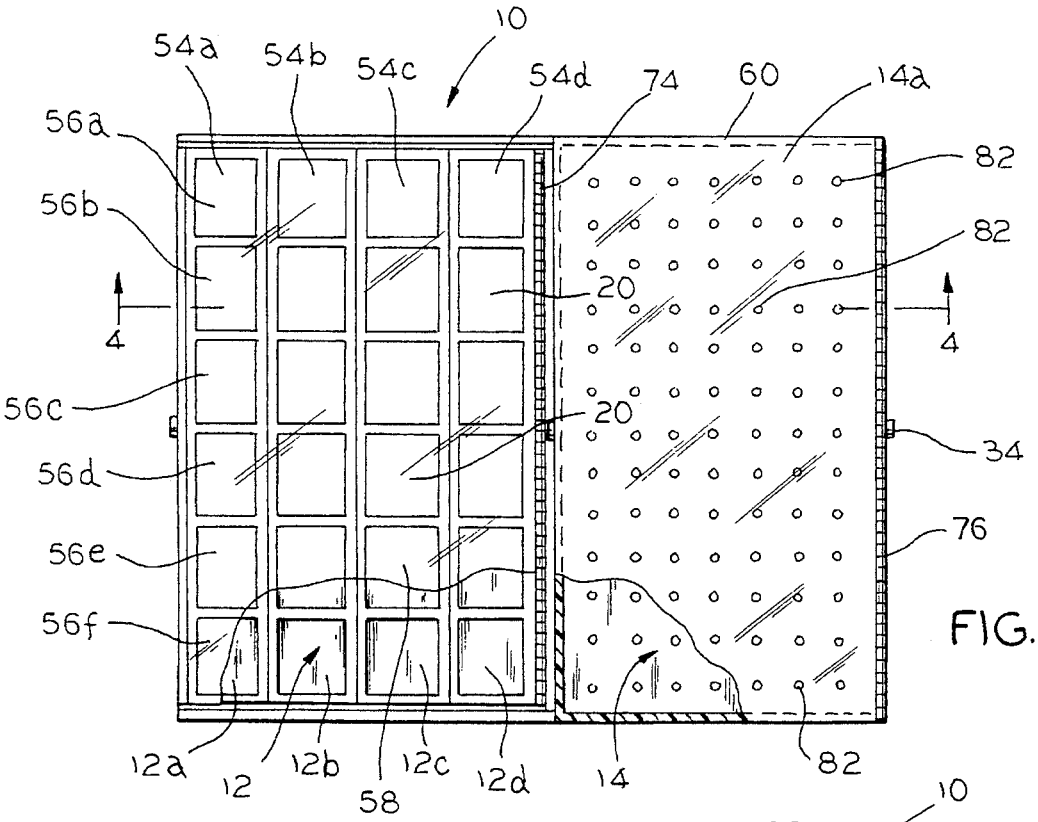
FIG. 3 is a top plan view of the product display and storage cabinet of FIG. 1 with the covers or lids in a lowered position.
Figure 4:
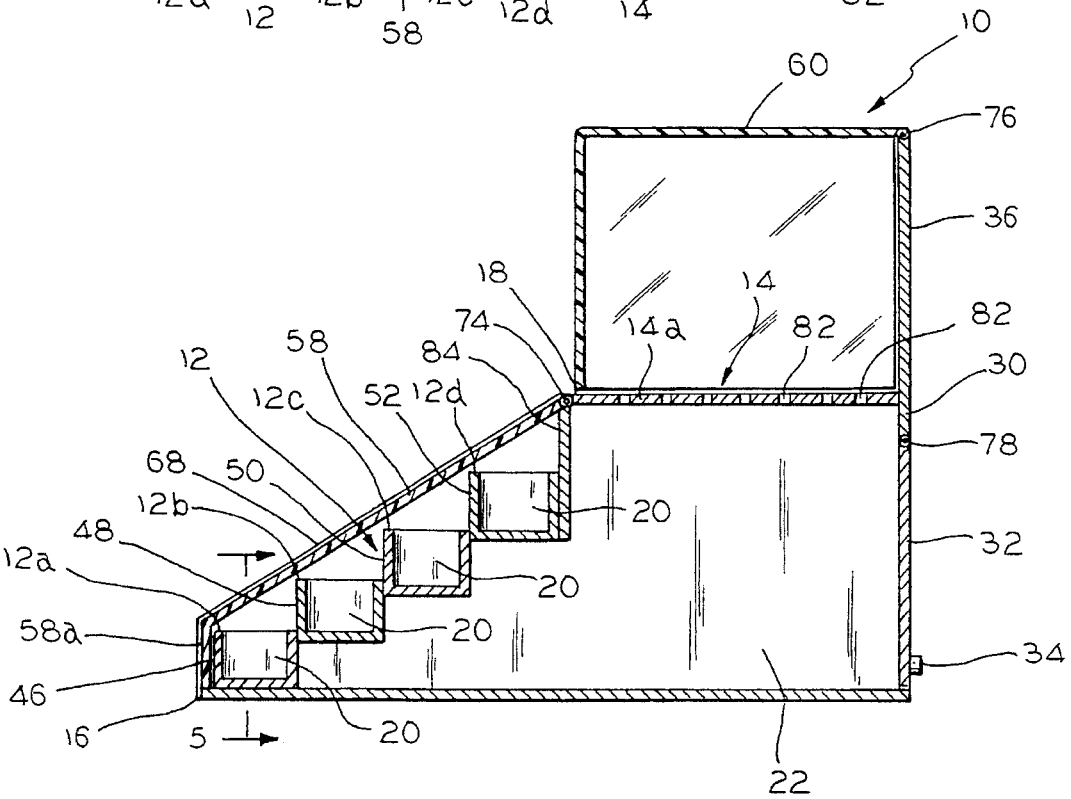
FIG. 4 is a cross-sectional view taken on the line 4—4 of FIG. 3 illustrating the internal structure of the product display and storage cabinet.
Figure 5:
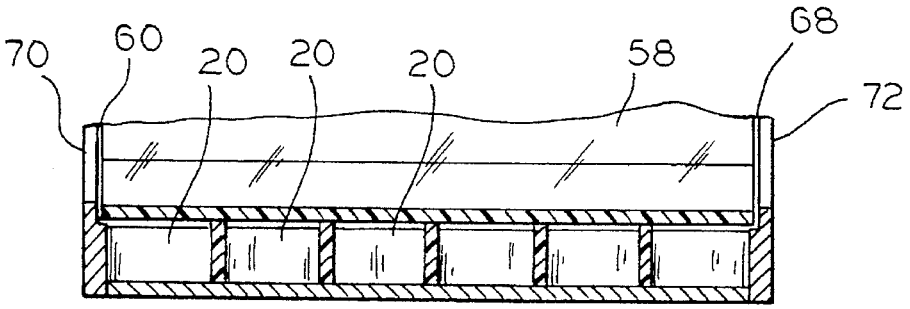
FIG. 5 is a cross-sectional view taken on the line 5—5 of FIG. 4 illustrating a product level of the product display and storage cabinet.
Figure 6:
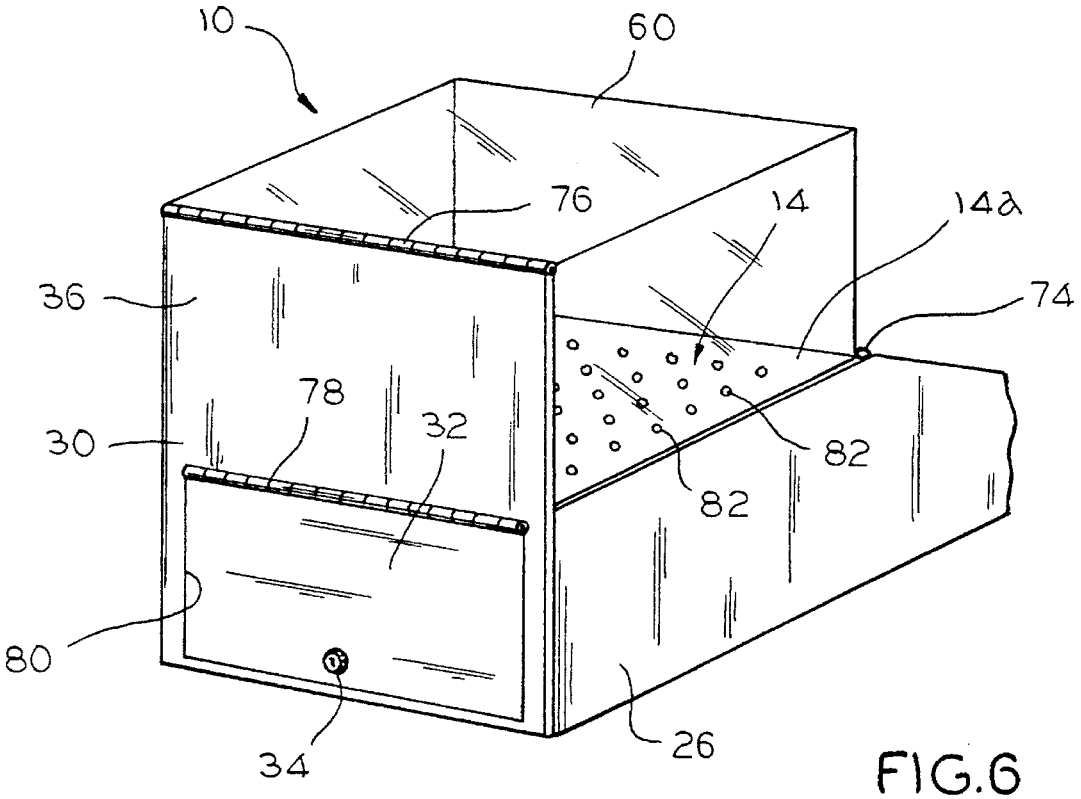
FIG. 6 is rear perspective view of the product display and storage cabinet in accordance with the present invention.

Referring to FIGS. 3 through 5, the first section 12 includes a plurality of product display bins 20 which are provided at each of the product display levels 12*a*, 12*b*, 12*c*, 12*d*. The second section 14 will also be understood from FIG. 4 to comprise a generally horizontal surface integral with and extending from the upper extreme 18 of the first section 12. And as shown in FIGS. 1, 2 and 6, the cabinet 10 includes a plurality of walls integrally surrounding the first and second sections 12 and 14 to define an enclosure 22 for product storage therein.

More specifically, the walls include a pair of generally or very nearly trapezoidal shaped side-walls 24 and 26 and a pair of parallel generally rectangular shaped front and back walls 28 and 30 which together define the enclosure 22. It will be seen that, in the illustrated embodiment (FIG. 4), the enclosure 22 will include not only space under the display bins 20 but also the considerable space below the generally horizontal surface comprising the single product display level 14*a* of the second section 14. Preferably, the cabinet 10 will be provided with an access door 32 for gaining entry into the product storage enclosure 22 which access door may have a lock 34 for selectively restricting access to products within the enclosure 22 only to authorized personnel.

Referring to FIGS. 1, 2, 4 and 6, the second section 14 includes a continuous outwardly facing vertical backstop 36 extending upwardly of the generally horizontal surface defining the single product display level 14*a* remote from the first section 12. It will also be seen that means such as flanges 38 and 40 are provided in association with the vertical backstop 36 to receive a card or the like for identifying and/or pricing one or more products displayed in the second section 14 immediately behind the generally horizontal surface defining the single product display level 14*a*. As will be appreciated, the vertical backstop 36 could also simply be printed with product identifying and/or pricing information, or means other than the flanges 38 and 40 could be provided to serve this product information-conveying function.

As shown in FIG. 1, the first section 12 can also advantageously have means such as flanges 42*a* and 44*a*, 42*b* and 44*b*, 42*c* and 44*c*, and 42*d* and 44*d* for a similar product information-conveying function. It will be seen in this connection that the product display levels 12*a*, 12*b*, 12*c*, 12*d* are each defined by a continuous outwardly facing vertical riser surface 46, 48, 50, 52 extending in front of all of the bins 20 at the particular product display level and, of course, the flanges 42*a* and 44*a*, 42*b* and 44*b*, 42*c* and 44*c*, and 42*d* and 44*d* can accept a printed card in like fashion to the flanges 38 and 40 on the vertical backstop 36 and for the same purpose. As with the backstop 36, the risers 46, 48, 50 and 52 can also be printed with product identifying and/or pricing information and/or other means for conveying such information can be provided.

As perhaps best shown in FIG. 3, the bins 20 are arranged in a plurality of rows 54*a*, 54*b*, 54*c*, 54*d* and columns 56*a*, 56*b*, 56*c*, 56*d*, 56*e*, 56*f* with the exact number of rows and columns being a matter of choice depending upon the products to be displayed in the bins 20. However, and as will be appreciated by comparing FIGS. 1 and 3, each of the rows 54*a*–54*d* define one of the product display levels 12*a*–12*d* and each of the columns 56*a*–56*f* are comprised of bins 20 that together define a plurality of vertical steps.

Referring to FIG. 2, the product display and storage cabinet 10 still further includes separate transparent means for covering the first section 12 and the second section 14 to restrict access while permitting viewing of products disposed within each of the sections. More specifically, the separate transparent means for covering the first section 12 and the second section 14 comprise hinged covers or lids 58 and 60 each having a lock 62 and 64, respectively, to restrict access to products therewithin. As will be appreciated, the locks 62 and 64 are optional depending upon the security requirements for the products to be displayed within the cabinet 10 and, moreover, such locks can be of a conventional type for product display cases and the like.

Referring to FIGS. 1, 2, 4 and 5, the hinged cover or lid 58 will be seen to comprise a generally planar lid normally resting on recessed ledges 66 and 68 of each of a pair of sloped surfaces 70 and 72 of the generally trapezoidal shaped side walls 24 and 26. It will also be seen that the hinged covers or lids include a generally rectangular bubble shaped lid 60 which rests on the generally horizontal surface defining the single product display level 14*a* of the second section 14 at a point forwardly of the vertical backstop 36. As best shown in FIG. 1, the planar lid 58 is preferably hinged by means of a piano-type hinge 74 generally at the upper extreme 18 of the first section 12 and the rectangular bubble shaped lid 60 is preferably hinged by means such as a piano-type hinge 76 generally at the top of the vertical backstop 36.

As a practical matter, the generally planar lid 58 may advantageously include a small downwardly angled portion 58*a* that will be generally vertically positioned when the lid 58 is in a closed position. Thus, it will be appreciated that the downwardly angled portion 58*a* of the generally planar lid 58 will be in close abutting relation to the first of the continuous outwardly facing vertical riser surfaces 46. In this manner, the lock 62 may function well in conventional fashion by having a locking portion which extends through and cooperates with the continuous outwardly facing vertical riser surface 46.

As for details of all of the locks 34, 62 and 64, they can all be of conventional construction as previously suggested.

Typically, they will each include a key and a locking finger or other element that will be movable from an "open" position to a "closed" position wherein the finger or other element is secured behind a surface of the cabinet 10 internally of the enclosure 22. For many applications of the cabinet 10, it may well be the case that the locks 34, 62, and 64 will not even be required.

As for the access door 32 (FIG. 6), it may also be hinged by means of a piano-type hinge 78, and it will further be seen that the vertical backstop 36 may actually be simply the upper portion of the overall back wall 30. In this case, the back wall 30 will simply have a suitable cutout 80 into which the hinged access door 32 will fit. While not forming a part of the invention, it will also be appreciated that the cabinet 10 may be formed of a plastic material with the walls 24, 26, 28 and 30 being opaque and the lids 58 and 60 being of a transparent plastic.

As best shown in FIG. 3, the generally horizontal surface comprising the single product level 14*a* of the second section 14 may include a plurality of holes 82 arranged in rows and columns. This facilitates utilization of the second section 14 for a variety of products and, in particular, short or tall drill bits or the like wherein a shank of reduced diameter may be inserted into the holes 82 which may be of the same or different sizes in different areas thereof. With this arrangement, the drill bits may be displayed standing vertically within the second section 14 under the cover or lid 60 where they will be highly visible to the consumer.

When there is product identifying information on the vertical backstop 36, it will be possible for the consumer to identify the drill bits by size, price and the like.

As will also be appreciated, the bins 20 serve well to display screwdriver tips and the like, although they also can be utilized for screws and/or other similar small items which may advantageously be displayed in bulk fashion. As with the vertical backstop 36, the continuous outwardly facing vertical riser surfaces 46, 48, 50, 52 may have product identifying information for the screwdriver tips, screws or the like such as size, price and other such information.

In fact, the additional vertical riser surface 84 immediately between the first section 12 and the second section 14 may have product identifying information concerning products in the first section 12 or the second section 14 or alternatively more general information relating to the product, company, store, etc.

While in the foregoing, there has been set forth a preferred embodiment of the invention, it will be appreciated that the details herein given may be varied by those skilled in the art without departing from the true spirit and scope of the appended claims.

I claim:

1. A product display cabinet, comprising:

first and second distinct product display sections arranged integrally adjacent to one another, said first section having a plurality of distinct product display levels extending from a lower extreme to an upper extreme in generally step-like fashion, said second section having a single product display level extending from said first section at said upper of said extremes;

said first section including a plurality of product display bins at each of said product display levels, said second section including a generally horizontal surface integral with and extending from said upper extreme of said first section, and a plurality of walls integrally surrounding said first and second sections to define an enclosure for product storage therein;

said product display levels each being defined by a continuous outwardly facing vertical riser surface extending in front of all of said bins at said product display level, and including means associated with said riser surface for identifying a product in each of said bins immediately behind said riser surface, said bins being arranged in a plurality of rows and columns with each of said rows defining one of said product display levels and each of said columns defining vertical steps; and separate transparent means for covering said first section and said second section to restrict access while permitting viewing of products within each of said sections, said separate transparent means including a generally planar lid covering said first section and a generally rectangular bubble shaped lid covering said second section.

2. The product display and storage cabinet of claim 1 wherein said second section includes a continuous outwardly facing vertical backstop extending upwardly of said generally horizontal surface remote from said first section.

3. The product display and storage cabinet of claim 2 including means associated with said vertical backstop for identifying one or more products displayed in said second section immediately behind said generally horizontal surface.

4. The product display and storage cabinet of claim 2 wherein said separate transparent means for covering said first section and said second section comprise hinged covers each having a lock to restrict access to products therewithin.

5. The product display and storage cabinet of claim 4 wherein said wails include a pair of parallel generally trapezoidal shaped side walls and a pair of parallel generally rectangular shaped front and back walls defining said enclosure.

6. The product display and storage cabinet of claim 5 wherein said generally planar lid normally rests on a recessed ledge of each of a pair of sloped surfaces of said generally trapezoidal shaped side walls.

7. The product display and storage cabinet of claim 6 wherein said generally rectangular bubble shaped lid rests on said generally horizontal surface forwardly of said vertical backstop.

8. The product display and storage container of claim 7 wherein said planar lid is hinged generally at the upper extreme of said first section and said rectangular bubble shaped lid is hinged generally at the top of said vertical backstop.

9. A product display cabinet, comprising:

first and second distinct product display sections arranged integrally adjacent to one another, said first section having a plurality of distinct product display levels extending from a lower extreme to an upper extreme in generally step-like fashion, said second section having a single product display level extending from said first section at one of said extremes thereof;

said first section including a plurality of product display bins at each of said product display levels, said second section including a generally horizontal surface integral with and extending from said upper extreme of said first section, and a plurality of walls integrally surrounding said first and second sections to define an enclosure for product storage therein; and separate transparent means for covering each of said first and second sections to restrict access while permitting viewing of products within each of said first and second sections, said separate transparent means including a generally planar lid covering said first section and a generally rectangular bubble lid coveting said second section.

10. The product display cabinet of claim 9 wherein said bins are arranged in a plurality of rows and columns with each of said rows defining one of said product display levels and each of said columns defining vertical steps.

11. The product display cabinet of claim 9 wherein said generally horizontal surface of said second section includes a plurality of holes arranged in a plurality of rows and columns each for supporting a product therewithin.

12. The product display cabinet of claim 9 wherein said second section includes a continuous outwardly facing vertical backstop extending upwardly of said generally horizontal surface remote from said first section.

13. The product display cabinet of claim 9 including an access door on said product storage enclosure having a lock for selectively restricting access to products within said product storage enclosure to authorized personnel.

14. The product display cabinet of claim 9 wherein said product display levels are each defined by a continuous outwardly facing vertical riser surface extending in front of all of said bins at said product display level.

* * * * *

UNITED STATES PATENT AND TRADEMARK OFFICE

CERTIFICATE OF CORRECTION

PATENT NO. : 5,496,103

DATED : March 5, 1996

INVENTOR(S) : Burton Kozak

It is certified that error appears in the above-identified patent and that said Letters Patent is hereby corrected as shown below:

column 6, line 32, replace "wails" with --walls--; and column 7, line 4, replace "coveting" with --covering--.

Signed and Sealed this

Twenty-third Day of July, 1996

*Attest:*

Bruce Lehman

BRUCE LEHMAN

*Attesting Officer*

*Commissioner of Patents and Trademarks*